US005419172A

United States Patent [19]

Kim

[11] Patent Number: 5,419,172

[45] Date of Patent: May 30, 1995

[54] CONTINUOUSLY CAST CARBON AND STAINLESS STEEL HOT-ROLLING MILL

[76] Inventor: Yong-Wu Kim, 9609 White Oak Ave., Munster, Ind. 46321

[21] Appl. No.: 96,867

[22] Filed: Jul. 26, 1993

[51] Int. Cl.[6] ..... B21B 13/22

[52] U.S. Cl. ..... 72/202; 72/227; 29/527.7

[58] Field of Search ..... 72/200, 202, 227; 29/527.7, DIG. 32; 164/417, 476; 242/78.1, 78.6, 79; 432/128, 143

[56] References Cited

U.S. PATENT DOCUMENTS

| | | | |
|---|---|---|---|
| 1,581,039 | 4/1926 | Tytus | 72/200 |
| 2,162,407 | 6/1939 | Manion | 72/227 |
| 4,296,623 | 10/1981 | Eibe | 72/227 |
| 4,942,656 | 7/1990 | Benedetti et al. | 29/527.7 |
| 5,212,856 | 5/1993 | DiGuisto | 29/527.7 |

FOREIGN PATENT DOCUMENTS

| | | | |
|---|---|---|---|
| 0038704 | 2/1987 | Japan | 29/527.7 |
| 0076701 | 4/1988 | Japan | 72/204 |

OTHER PUBLICATIONS

Article Entitled: I.S.P. Inline Strip Production—Demag/Arvedi (Believed to be prior art.).

*Primary Examiner*—Lowell A. Larson
*Assistant Examiner*—Thomas C. Schoeffler
*Attorney, Agent, or Firm*—Charles W. Chandler

[57] ABSTRACT

A method and apparatus for hot-rolling a slab of steel in which a cast slab is heated in a tunnel furnace to a hot-rolling temperature, rolled to a lesser thickness in a tandem mill, reheated in the same tunnel furnace and then rerolled in the same tandem mill to a final thickness.

1 Claim, 2 Drawing Sheets

CONTINUOUSLY CAST CARBON AND STAINLESS STEEL HOT-ROLLING MILL

BACKGROUND OF THE INVENTION

This invention relates to a process for hot-rolling a carbon or stainless steel that has already been hot-rolled by a tandem or other process. More specifically, it is related to a process for using a tandem hot-rolling mill for reducing the thickness of a carbon or stainless steel by reheating a coil of hot-rolled steel and then rerolling the coil in the same tandem rolls used to initially roll the coil.

Hot-rolling is the most widely used method to shape a cast slab into a coil form. No other process is as effective or as efficient as hot-rolling in reducing slabs of, say, 0.8" thick to 0.1". However, one of its disadvantages is scale formation during or after rolling due to the high temperature operation. As a result, the surface appearance and gage uniformity of hot-rolled products are inferior to those of cold-rolled products.

Further, it is impractical to roll a slab beyond a product width-to-thickness ratio of 1000:1. This limit is primarily due to the non-uniform temperatures existing across the width of a coil generated by the long slab processing sequence, and the excessive roll forces required for further reduction.

In spite of these disadvantages, the commercial and industrial value of thin gage, hot-rolled products has been recognized for some time. Many high strength carbon and stainless steels are work-hardened so rapidly during cold-rolling that either a very high rolling force or a special roll arrangement is required for processing, such as expensive Sendzimir mills, for obtaining lighter gage stainless steel. One way to tolerate the work-hardening behavior is to start with a thin gage hot-rolled steel, minimizing the subsequent cold reduction requirement.

Attempts have been made to manufacture hot-rolled thin gage steel by changing the roll arrangement, such as using planetary and cluster mills. In principle, the smaller the working roll diameter is, the more reduction it can achieve. Hence, most roll mill designers are working on the support system of the small-size work roll. However, little progress has been made in developing low-cost, hot-rolling technology for achieving thin gage steel.

Mannesmann Demag Huttentechnik, a supplier to the metallurgical industry, and Finarvedi in Cremona, Italy, an Italian company in the field of producing special steels, has developed the I.S.P. (Inline Strip Production) process. This process produces hot-rolled strips.

In this process, thin slabs are produced, induction heated, rolled into an intermediate gage, and then coiled onto a mandrel in a special furnace. This special furnace allows two strips to be housed in such a way that while one strip is coiled onto one mandrel, a second strip on a second mandrel is uncoiled and sent to the tandem hot-rolling stands without losing temperature. In this way, relatively thin gage, hot-rolled steels can be obtained. This development is essentially a combination of the Steckel mill concept and tandem rolling mills. The Steckel mill is widely used by the stainless and alloy steel manufacturers who do not have a tandem rolling mill.

Some of the disadvantages of the Demag/Arvedi I.S.P. process are the extra capital investment required for installing an additional rolling mill and the limit of the gage that it can produce.

SUMMARY OF THE INVENTION

The broad purpose of the present invention is to provide a method and apparatus for producing thin gage hot-rolled steel in which a cast slab is initially introduced into a tunnel furnace to increase its temperature to a hot-rolling temperature. It is then rolled to reduce its thickness, coiled on a coiler, and then transferred to a position adjacent the entrance of the tunnel furnace. The coil may be placed in a temporary position at or near the entrance of the furnace, thereby permitting a second cast slab or subsequent slabs to be processed in the furnace. The uncoiled steel is then introduced into the main furnace and reheated to its hot-rolling temperature. It is rolled a second time to reduce its thickness to a final dimension, coiled and removed from the process. The steel is thus rolled twice in the same tandem rollers, being reheated after the first pass through the rollers to raise its temperature to an appropriate working temperature.

In order to understand the present invention and its novelties, some recent developments in mini-mill technologies must be understood. These mills have incorporated several new technologies into their operation such as the thin-slab casting technology and a long tunnel furnace to uniformly heat the slab for hot-rolling. The presence of the tunnel furnace plays a critical role for this invention. Unlike the conventional reheating furnace, the tunnel furnace has individually driven hearth rolls that allow the slab to continuously move at variable speeds. The same furnace is convenient for reheating already hot-rolled coil for a second hot-rolling. Here, in this invention, it is sometimes referred to as rehot-rolling.

Presumably, due to the uniformity of the temperature across and throughout the slab and recent technological improvements in hot-rolling, mini-mills can produce hot-rolled coils with ±-0.001" variations in thickness across the width and ±0.005" throughout the coil. This is close to the thickness control of cold-rolled steel and makes hot-rolled products more attractive for many applications.

In mini-mill operation, a typical casting speed is 5 m/min, slab thickness is 50 mm, rolling entry speed is 20 m/min, and the tunnel furnace is 168 m long.

This difference between casting and rolling speeds generates a time interval between successive slabs. This invention uses this time interval for rehot-rolling. During this interval, a hot-rolled coil of relatively thick gage is delivered to the tunnel furnace entrance for decoiling and reheating. The tandem mill then re-rolls the coil during that time interval when the mill would normally be in an idle condition.

The time interval between two successive slabs varies with the slab sizes to the extent that it causes an engineering as well as a scheduling problem. The present invention provides a temporary storage area at the furnace entrance to accommodate this problem. The incoming cast slabs are stored in this area while the once rolled coils are being decoiled and reheated. Although this storage area can be located in front of the decoiler, building an enlarged side section at the tunnel furnace entrance saves space and construction costs.

The storage area permits a long cast slab to be moved sideways into the furnace. A conventional sliding mechanism and inclined skids are used for moving the cast slab. However, other methods such as a roll table or a walking beam arrangement can be used. Up to 4 slabs may be stored, however, the storage area can be expanded, allowing 22 minutes for the preparation of decoiling and rehot-rolling. In this calculation, a 35.1 m long, 1.52 m wide, 63.5 mm thick slab is assumed.

Decoiling a heavy hot-rolled coil and tracking the coil along the long tunnel furnace is an engineering problem. However, a number of well-known solutions may be found in pickling and galvanizing lines. These lines employ several techniques to flatten a hot-rolled coil during decoiling and to pass the coil through a long tunnel furnace without either being blocked by the hearth rolls or going astray.

Preferably, inclined skids are used for moving a cast slab from the storage area to the tunnel furnace. Hearth rolls are positioned under the skids so that their ends are exposed to the outside of the furnace. This arrangement is not particularly extraordinary, since the skids themselves are inclined to easily move a slab.

For reheating a rolled coil, the rolling entry speed is increased to accommodate the time available for the storage of slabs. Variable entry rolling speed is an option, because not every coil is rehot-rolled.

Since the reheated-rolling reduces the thickness of a coil nearly to the final cold-rolled gage, the burden of a cold-rolling mill to produce the final gage becomes relatively light. In fact, instead of using an expensive Sendzimir mill, a reverse rolling mill may be used to roll to the final gage. This will significantly reduce the processing cost of cold-rolled stainless steel and other grades of steel. It is also possible to directly ship the product after a heavier temper rolling of 2–5%.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
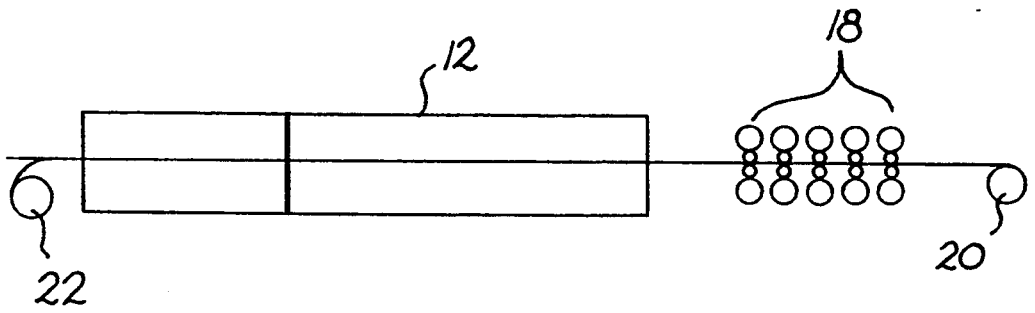
FIG. 1 is a schematic side view illustrating portions of a tunnel furnace embodying the present invention.

Referring to the drawings, continuous caster 10 intermittently delivers thin cast slabs of steel to a tunnel furnace 12. Four slabs 14, 16, 18 and 20 are temporarily stored adjacent furnace entrance 22. For illustrative purposes, an AISI 409 steel is employed. Each slab is cast at 5 m/min per minute casting speed and is 2½" thick, 60" wide. Each slab has a length of 26.5 m. corresponding to 20 metric tons.

Figure 4:
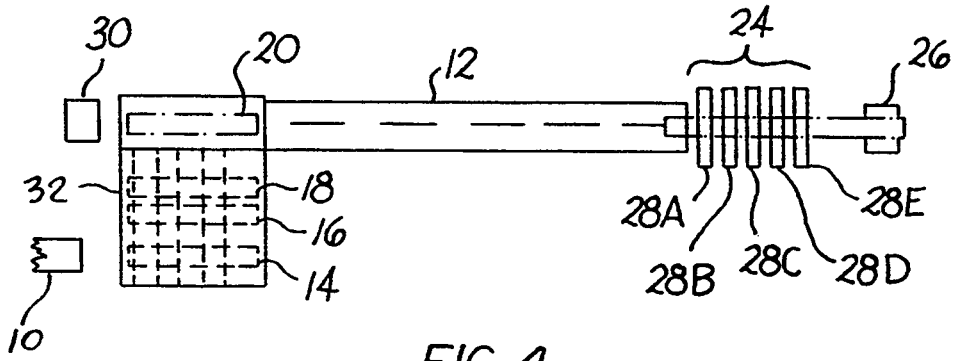

The main body of tunnel furnace 12 is conventional, and available from various furnace builders who build horizontal, galvanizing and annealing furnaces. It is 168 m long. The furnace has a variable speed entry means to accommodate the length of the particular slab being heated or reheated. Referring to FIG. 4, slab 20 is pushed into the furnace entrance and then is moved along the length of the furnace. The slab's temperature may be increased up to 2100° F. Slab 20 passes through the furnace and then is delivered to a tandem mill 24. Mill 24 reduces the slab's thickness to 0.25" as its temperature cools to about 1500° F. The rolled slab leaves mill 24 and is wound into a coil upon coiler 26 in the manner well known to those skilled in the art.

During the first pass, slab 20 is reduced in thickness to 1.25" at the first roller 28A, to 0.75" at the second roller 28B, to 0.45" at the third roller 28C, to 0.29" at the fourth roller 28D, and to 0.25" at the fifth roller 28E.

Slab 18 then follows in the path of uncoiled slab 20 through the furnace for heating the mill for initial rolling and then the coiler for coiling.

Figure 5:
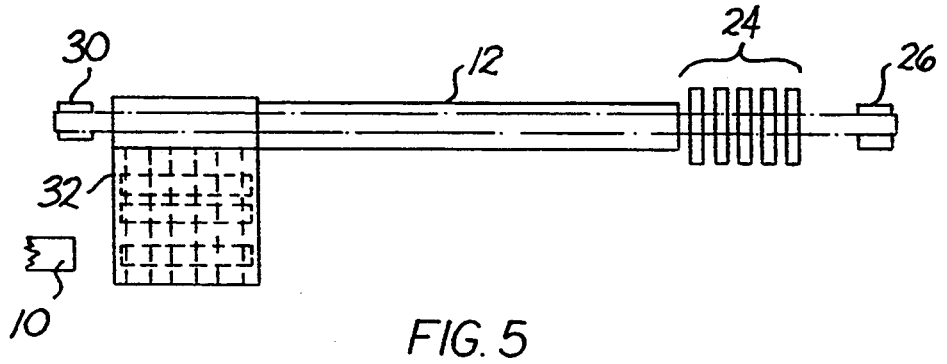

Referring to FIG. 5, the initial slab 20 is then delivered to a decoiler 30. Decoiler 30 has means to flatten the curved shape.

Figure 6:
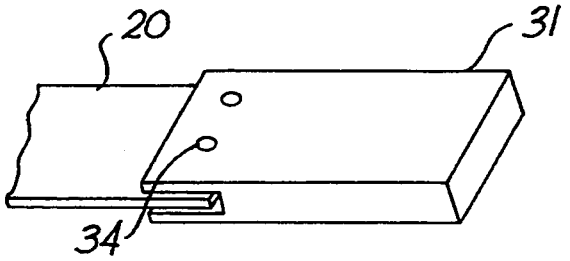
FIG. 6 illustrates a dummy slab connected to a once-rolled coil.

Referring to FIG. 6, the leading end of uncoiled slab 20 is connected to a dummy slab 31 by fastener means 34. Dummy slab 31 weighs about 10 tons and is about 10 feet in length. It acts as a pilot, guiding the uncoiled end of the slab through the length of the furnace, keeping the slab straight until it reaches the mill. The dummy slab is then removed and the slab is then re-rolled in mill 24.

As the uncoiled steel slab moves through the furnace, its temperature steadily increases to a working temperature of 2100° F. for rehot-rolling. The optimum temperature for rehot-rolling depends upon the steel grade and desired mechanical properties.

The adjustable rolls of tandem mill 24 then further reduce the thickness of slab 20 to a final gage of 0.0247".

The final thickness can be adjusted by omitting one or more stands of the mill. Slab 20 is then removed from the process, either to a cold rolling process or it may be used in its final form from the rehot-rolling process. Coil 18 continues in the same path as slab 20. Thus, the mill alternates between rolling a cast slab to a thickness of 0.25" and then re-rolling a once rolled slab to a final gage of 0.0247".

Figure 2:
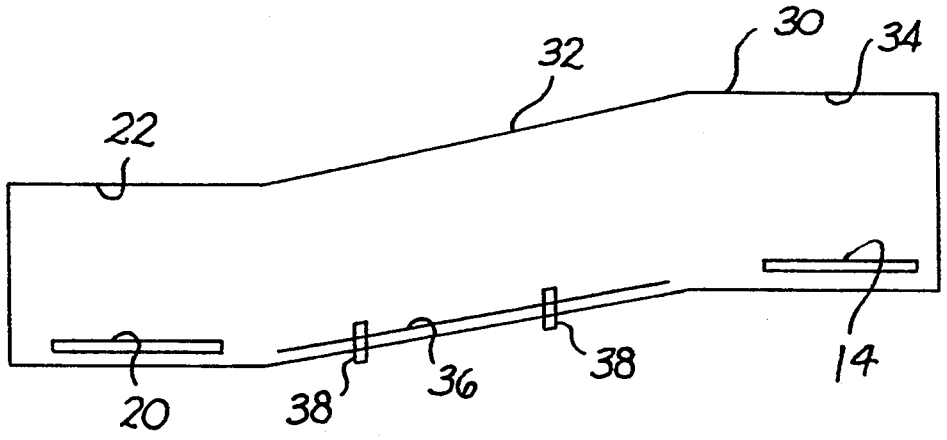
FIG. 2 is an enlarged front view of the entrance of the tunnel furnace.
Figure 3:
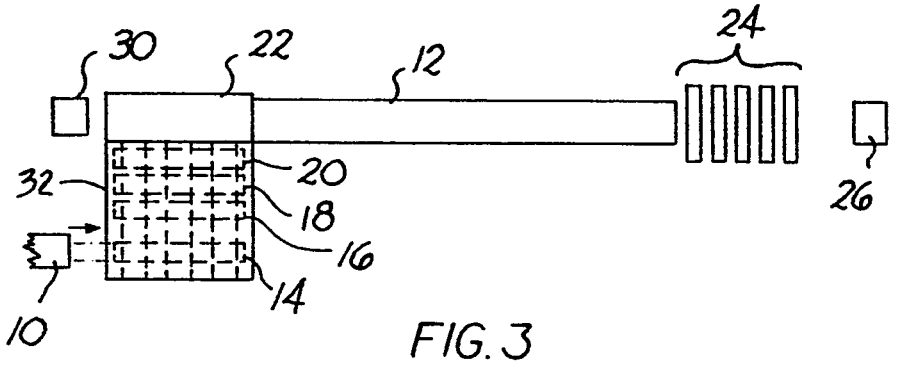
FIGS. 3–5 are plan views of the apparatus to illustrate the steps in carrying out the preferred method.

Referring to FIG. 2, the forward end of the furnace, that is the part containing entrance 22, has a lateral housing extension 32 with an opening 34 for receiving the slabs from caster 10. The furnace entrance can be widened or heightened, as necessary, to contain several slabs in a temporary storage position on skid means 36. Skid means 36 support slabs 14, 16, and 18. Hydraulically-actuated pusher rod means 38 advance the individual slabs from their stored position into the main body of the furnace, i.e. the position previously occupied by slab 20. Each slab is held in the stored position until there is a sufficient time interval for it to be moved into main tunnel 16.

Unlike conventional reheating furnaces, the temperature in the transition stage between the storage area and the main furnace entrance is relatively low, thus, a water-cooled skid is not necessary. However, ceramic or alloy inclined skids are preferably used for construction. Hydraulically-activated pusher rods trigger the movement of the slabs.

Thus, it is to be understood that I have described a process in which a slab of steel is heated, rolled, coiled, decoiled, reheated in the same tunnel furnace through which it initially was heated and then rerolled to a final thickness, in the same mill that it was initially rolled. The process makes a more efficient use of the furnace because it utilizes the time interval between successive slabs delivered from the casting means. The process is coordinated to optimize the movement of both the initial slabs and the once-rolled slabs. A minimum amount of time is allowed between heating the initial slab and reheating the once-rolled slab to adjust the rehot-rolling parameter.

In order to reduce energy consumption, the once hot-rolled slabs are brought to the tunnel furnace entrance, as soon as possible.

The tunnel furnace has been modified to provide several important functions;

1. It provides a temporary storage for cast slabs to accommodate the rehot-rolling schedule.

2. It maintains the cast slab temperature constant.

3. It provides for a smooth lateral movement of the cast slabs into the furnace.

Having described my invention, I claim:

1. A hot-rolling mill for rolling a cast slab of metal to a reduced thickness in a first stage, and then rerolling the once-rolled slab to a lesser thickness in a second stage, comprising:

a continuous casting means (10) constituting a source of cast slabs having a first thickness;

a stationary tunnel furnace (12) having entrance means (22) for receiving either a slab of metal of said first thickness, or a hot-rolled uncoiled slab of metal of a lesser, second thickness;

said tunnel furnace being operative to increase the temperature of either the slab of metal of said first thickness or the uncoiled slab of metal of said second thickness to a hot-rolling temperature and to pass a slab of metal to a mill means;

mill means (24) having adjustable rolls for either rolling a slab received from the tunnel furnace from said first thickness to said second thickness, or for rolling an uncoiled slab of metal from said second thickness to a lesser third thickness;

coiler means (26) for coiling a slab of metal of the second thickness as it is discharged from said mill means;

decoiler means (30) located at the entrance means (22) of the tunnel furnace for uncoiling a coiled slab of metal of the second thickness, and for re-introducing the uncoiled slab of metal to the furnace to reheat the uncoiled slab of metal to a hot rolling temperature;

whereby the reheated uncoiled slab of metal is rolled from said second thickness to said third thickness by the mill means after leaving the tunnel furnace;

said tunnel furnace having a temporary storage section (32) for receiving slabs of metal from said casting means, said temporary storage section having means (38) for moving slabs of metal into said entrance means (22), whereby the tunnel furnace is supplied with slabs of metal of said first thickness interspersed with uncoiled slabs of metal of said second thickness.

* * * * *